US005152530A

United States Patent [19]

Dodek, II

[11] Patent Number: 5,152,530

[45] Date of Patent: Oct. 6, 1992

[54] BOLT BLOCK PUZZLE APPARATUS

[76] Inventor: Samuel M. Dodek, II, 12808 Huntsman Way, Potomac, Md. 20854

[21] Appl. No.: 651,034

[22] Filed: Jan. 31, 1991

Related U.S. Application Data

[63] Continuation of Ser. No. 494,288, Mar. 16, 1990, abandoned.

[51] Int. Cl.[5] ..... A63F 9/06

[52] U.S. Cl. ..... 273/156; 446/123; 273/160

[58] Field of Search ..... 273/153 R, 153 P, 156, 273/160; 446/123, 144; 434/260, 401, 403

[56] References Cited

U.S. PATENT DOCUMENTS 1,701,190 2/1929 Paulson ..... 446/123

FOREIGN PATENT DOCUMENTS 816895 7/1959 United Kingdom ..... 446/123

*Primary Examiner*—Theatrice Brown
*Assistant Examiner*—William M. Pierce

[57] ABSTRACT

A puzzle having a plurality of bolts, a plurality of nuts and a plurality of blocks. The plurality of bolts includes having each bolt with a first end with a head, and a second end with threads, with each bolt having a size different from another bolt. The plurality of nuts includes having each nut with threads for screwing the nuts onto the bolts. The plurality of blocks includes having each block with a plurality of holes passing therethrough, for passing of the plurality of bolts. In use, the plurality of blocks assembles in a unique pattern with the plurality of bolts passing through the holes of at least two of the blocks holding the blocks together with the nuts.

9 Claims, 2 Drawing Sheets

BOLT BLOCK PUZZLE APPARATUS

This application is a continuation of application Ser. No. 07/494,288, filed Mar. 16, 1990, now abandoned.

BACKGROUND OF THE INVENTION

This invention relates to puzzles, and more particularly to a three dimensional puzzle employing blocks and screws which combine in a particular pattern.

DESCRIPTION OF THE PRIOR ART

Two dimensional puzzles have been around for a long time. Commonly, these puzzles employ the use of pieces which have been cut out from some hard material such as wood or cardboard. The pieces may combine together to form a picture or other display.

In recent times, three dimensional puzzles have come into existence. The rubics cube which comprises a plurality of cubes which can be twisted along all three axes, allow a person to twist the cube to form a particular pattern. The three dimensional puzzle using the rubics cube, however, requires having all the cubes connected together and twist and not separate.

Missing in the prior art is a general puzzle made from plain pieces which can go together in only one particular pattern.

OBJECTS AND SUMMARY OF THE INVENTION

An object of the present invention is to provide a three dimensional puzzle having non-symmetric or non-geometric blocks.

Another object of the present invention is a puzzle requiring the understanding of spacial concepts for assembling the pieces to form a particular pattern.

A further object of the present invention is a three dimensional puzzle which is educational and entertaining.

According to the present invention, as embodied and broadly described herein, a bolt block puzzle apparatus is provided comprising a plurality of bolts, a plurality of nuts, and a plurality of blocks. The plurality of blocks includes having non-symetric or non-geometric blocks, each block with a plurality of holes for passing one end of a bolt. The plurality of bolts includes having each bolt with a first end with a head, and a second end with threads. The plurality of nuts includes having each nut with threads for screwing the nuts onto the bolts. In use, the plurality of blocks assembles in a unique pattern with the plurality of bolts passing through the holes of at least two of the blocks, holding the blocks together with the nuts. The difficulty of assembling the bolt block puzzle apparatus is in positioning the blocks into the unique pattern, requiring alignment of all the holes for passing the bolts through the blocks, and assembling the blocks back into their original position.

Additional objects and advantages of the invention will be set forth in part in the description which follows, and in part will be obvious from the description, or may be learned by practice of the invention. The objects and advantages of the invention also may be realized and attained by means of the instrumentalities and combinations particularly pointed out in the appended claims.

BRIEF DESCRIPTION OF THE DRAWINGS

The accompanying drawings, which are incorporated in an constitute a part of this specification, illustrate particular embodiments of the invention, and together with the description, serve to explain the principles of the invention.

DETAILED DESCRIPTION OF THE PREFERRED EMBODIMENTS

Reference will now be made in detail to the present preferred embodiments of the present invention, examples of which are illustrated in the accompanying drawings.

Figure 1A:
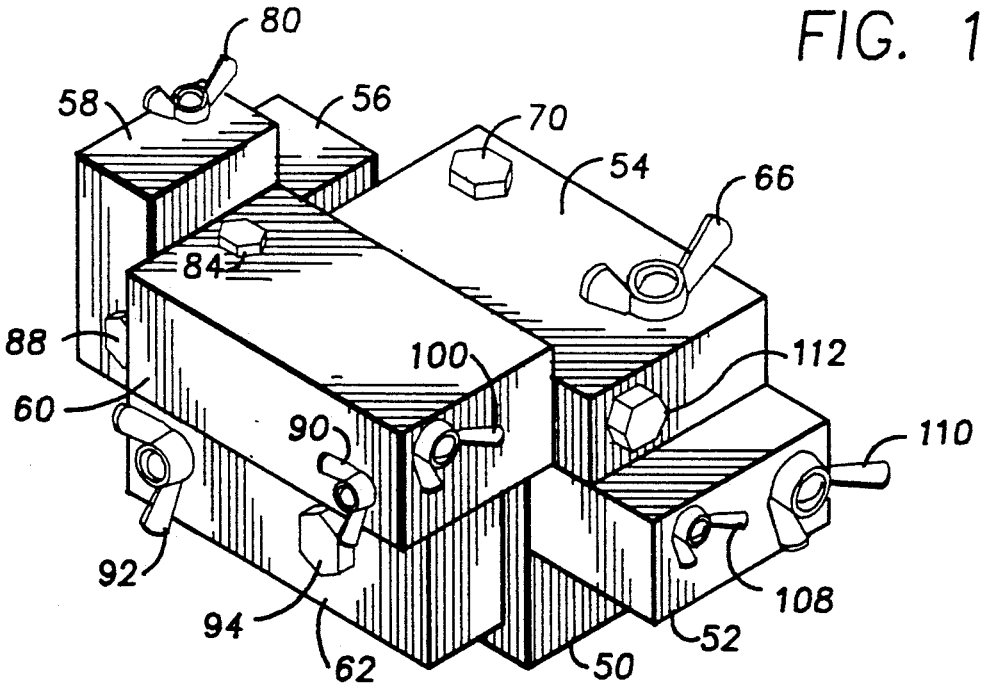
FIG. 1A is an isometric view of a first embodiment of a bolt block puzzle apparatus according to the present invention.
Figure 1B:
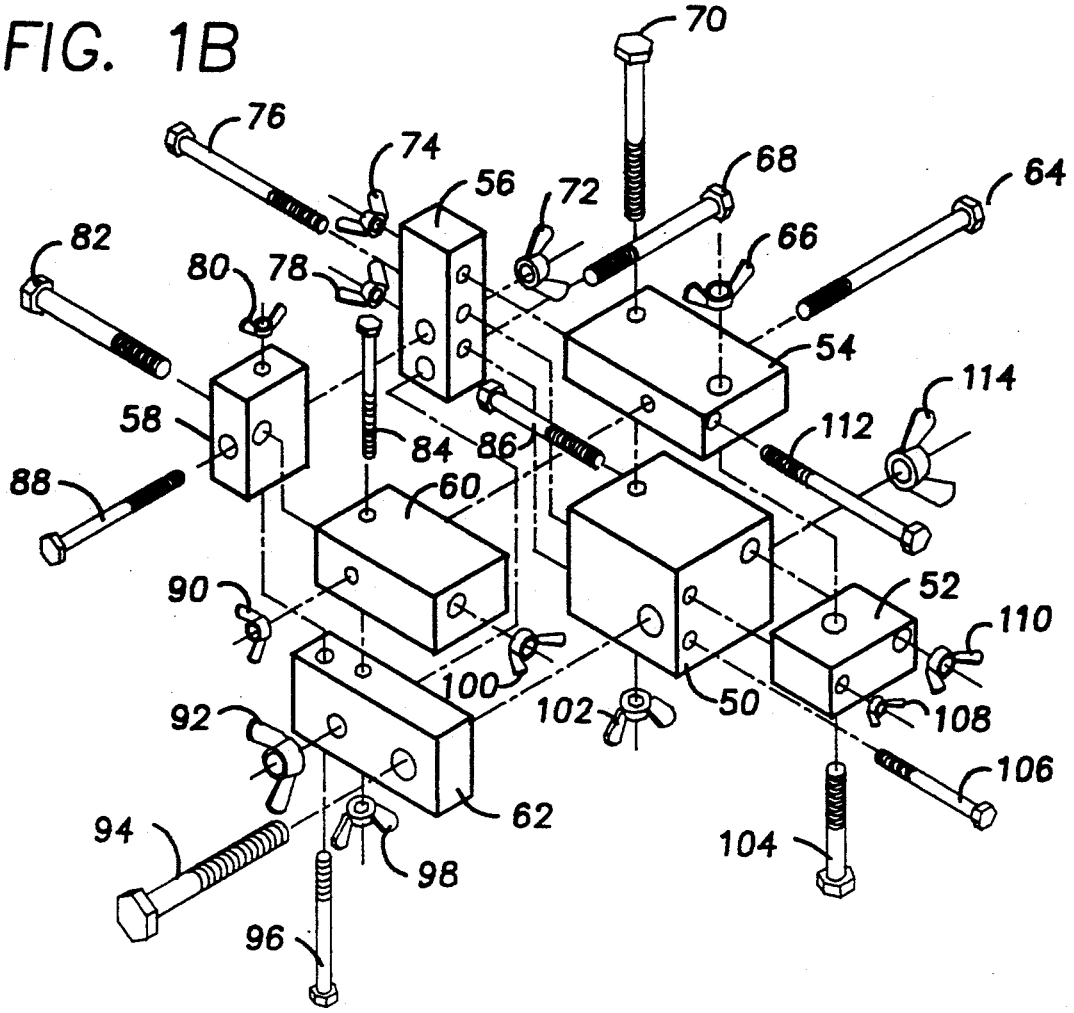
FIG. 1B shows the assembly of the first embodiment of the bolt block puzzle apparatus of the present invention.

Referring to FIG. 1A and FIG. 1B, a first embodiment of a bolt block puzzle apparatus according to the present invention is shown. In the exemplary arrangement shown, the bolt block puzzle apparatus comprises a plurality of non-symmetric blocks 50, 52, 54, 56, 58, 60, 62 a plurality of first means, and a plurality of second means. The plurality of first means may be embodied as a plurality of bolts with each bolt having a first end with a head, and a second end with threads. The plurality of second means may be embodied as a plurality of nuts, with each nut having threads for screwing the nuts onto the bolts. The plurality of blocks includes having each block with at least two holes passing through each block. The holes are for allowing a bolt to pass through the block.

The plurality of first means alternatively may be embodied as cylindrical, rectangular or other shaped, joining devices which would plug the holes filled by the bolts. The joining devices would not require a nut or threading or a head, but would be punched or pushed through the holes passing through the blocks, with thumb or fingers.

In use, the blocks assemble in a unique pattern with the holes aligned for the bolts to pass through the holes and the nuts to screw onto the threaded end of the bolts. The bolts and nuts hold the blocks together. The difficulty of the bolt block puzzle apparatus is in determining the alignment of the blocks with the holes for allowing the puzzle to come together.

In the exemplary arrangement as shown in FIG. 1A, the plurality of blocks includes a first block 50, a second block 52, a third block 54, a fourth block 56, a fifth block 58, a sixth block 60, and a seventh block 62. The first, second, third, fourth, fifth, sixth, and seventh blocks 50, 52, 54, 56, 58, 60, 62 assemble such that the plurality of bolts 64, 68, 70, 76, 82, 84, 86, 88, 92, 94, 96, 104, 106, 112 pass through holes of the plurality of blocks, with the plurality of nuts 66, 72, 74, 78, 80, 90, 92, 98, 100, 102, 108, 110, 114 connected thereto.

FIG. 1B shows the first block 50, second block 52, third block 54, fourth block 56, fifth block 58, sixth block 60, and seventh block 62 disassembled, with the alignment for the plurality of bolts to pass through the holes of the blocks, thereby assembling the blocks in the unique pattern of FIG. 1A.

Figure 2A:
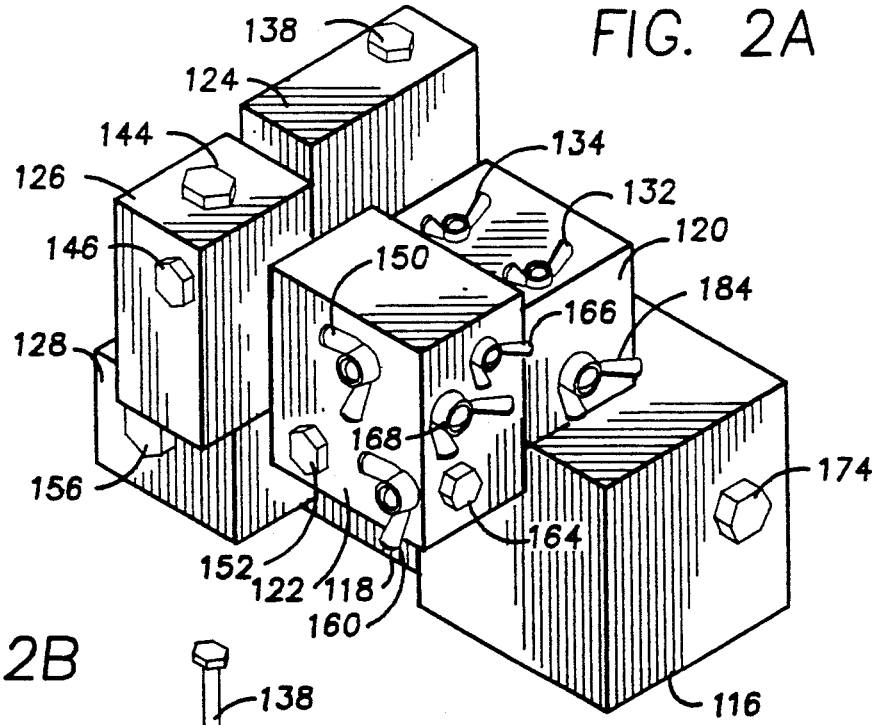
FIG. 2A is an isometric view of a second embodiment of a bolt block puzzle apparatus according to this present invention.
Figure 2B:
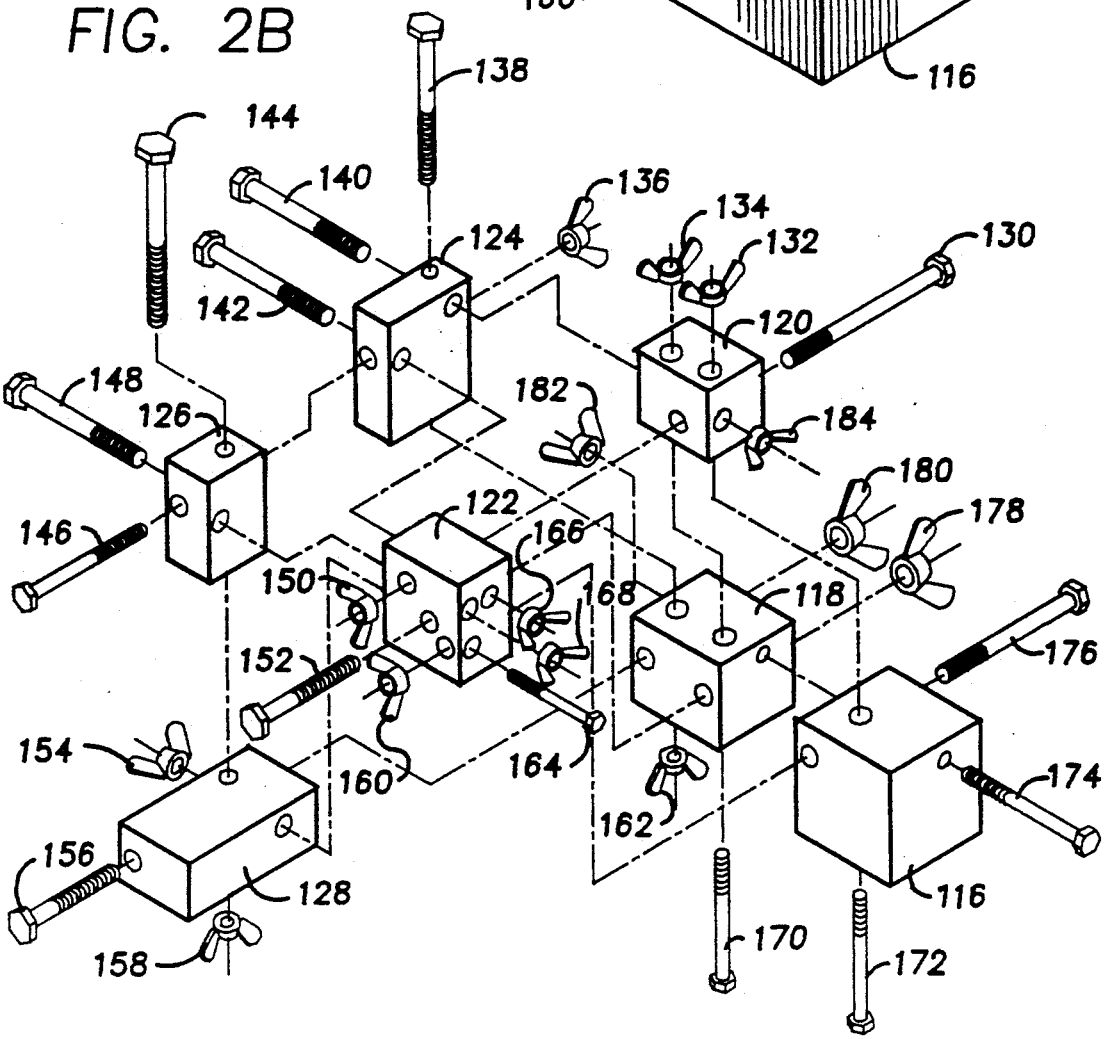
FIG. 2B shows the assembly of the second embodiment of the bolt block puzzle apparatus of the present invention.

FIG. 2A illustratively shows a second embodiment of a bolt block puzzle apparatus according to the present invention. The second embodiment includes a first block 116, a second block 118, a third block 120, a fourth block 122, a fifth block 124, a sixth block 126, and a seventh block 128. The blocks assemble in a unique pattern allowing the holes to align as shown in FIG. 2B. The plurality of bolts 130, 138, 140, 142, 144, 146, 148, 152, 156, 164, 170, 172, 174, 176, pass through the holes of the plurality of blocks. The plurality of nuts 132, 134, 136, 150, 154, 158, 160, 162, 166, 168, 178, 180, 182, 184 connect to the plurality of bolts. FIG. 2B illustrates the bolt block puzzle apparatus of FIG. 2A disassembled with the alignment of the holes.

The present invention, in use, requires aligning the blocks with the holes in a unique pattern. No other pattern will allow putting the bolt block puzzle apparatus together utilizing all the blocks, bolts and nuts.

In practice, the puzzle is entertaining and educational. The puzzle requires understanding three dimensional concepts and spacial relationships with the blocks, the bolts, and the holes. The blocks may include having blocks and bolts of different sizes, and generally having the blocks with at least two or more holes passing therethrough. More or fewer blocks may be employed than those shown in the figures. Additionally, certain designs may be painted onto the blocks, such as lines, arrows, and dots, on the outside of the blocks, which may facilitate aligning blocks into a particular pattern. Other types of patterns or pictures may be painted on the blocks for facilitating assembling the blocks in a particular relationship.

Broadly, the bolt block apparatus includes a compilation of three dimensional manipulative puzzles which challenge the organization, capabilities, and logical thinking skills of a participant. Three levels of puzzles, primary, intermediate, and advanced, include rectangular solid blocks with some of the blocks permanently joined and others free standing, which serve as receptors for bolts of uniquely assorted length and/or diameters. Several attributes are employed in combination to control the degree of difficulty;

1. The number of blocks in the puzzle;
2. The color of the blocks;
3. The number and variety of bolts;
4. Bolts with all of one color or having each colored at the ends to match the color of the block through which it enter and exits;
5. The use of directional arrows to assist in the orientation of the blocks;
6. The use of intersecting or parallel bands of same/-different colors which surround the entire puzzle only or individual blocks; and
7. Dots which identify fully exposed exterior faces when used.

Intermediate and advanced six-sided loose block puzzles require many clues to be referenced and juggled simultaneously. After careful study, the task is to remove the bolts, scramble the blocks, and then to reassemble the puzzle so all bands appear unbroken.

As an example of a primary group of puzzles, two puzzles are presented. The first puzzle comprises ten permanently free-joined different colored blocks which house 29 uniquely-sized bolts. Bolts and nuts are colored to match the block color through which each enters and exits. Puzzles in this group can be enjoyed by young children until their thought processes mature. This group is especially useful with pre-schoolers and the physical and mentally handicapped since meaningful basic learning and therapeutic tasks can be assigned. With the bolt-block puzzle there is no language barrier or advantage. A non-verbal demonstration can get a person started almost as quickly and effectively as a verbal one. Tasks such as removing and restoring varying numbers of bolts or specific colors challenge estimation and dexterity since the blocks in this group are fixed, the puzzler is not faced with the arranging of loose blocks and bolts as he would be with the intermediate and advanced group.

A second example of a primary puzzle includes a configuration as the first example; however, while both attributes are diverse, all of the blocks are the same color. Bolts are divided into groups of five, nine and fifteen and each of these groups is identified by its unique color.

Unlike the first puzzle, there is no correlation between the colors of the blocks and those of the bolts. Progression from removing one set of bolts at a time to dealing with a combination of two or more sets is recommended.

In the intermediate group, the following five puzzles are given as examples.

A first example of an intermediate puzzle includes using four different color blocks joined by six bolts colored at either end to match the color of the block through which it enters and exits. There are two intersection different colored bands around the outside of the joined configuration and a directional arrow on each block, all of which point in the same direction in the properly assembled puzzle.

A second example in the intermediate group may use six blocks joined by eleven bolts, with each colored as point of entry and exit. Each of the puzzle's six faces is a different colors. Bands as in the first intermediate puzzles are present.

A third example of an intermediate puzzle includes using six blocks with each having a different color joined by ten bolts colored as before. Three intersection different colored bands surround the puzzle and individual blocks are banded. A directional arrow is displayed on each block and a dot appears on every fully-exposed face of each block. No partially or fully hidden face is dotted.

A fourth example of an intermediate puzzle includes having five blocks with all one color joined by nine one-colored bolts. Two intersecting same-colored bands surround the puzzle and individual blocks as well. Dots may be displayed to identify all fully exposed faces of each block. No dot appears on partially or fully concealed faces. Directional arrows may be present.

A fifth example of an intermediate puzzle comprises six blocks joined by eleven same-colored bolts. Three faces of the puzzle are one color and three faces of the puzzle are a second color. Two same-color parallel bands surround the puzzle and individual blocks as well. Directional arrows and dots are also present as previously described.

The advanced group of the bolt block puzzle apparatus is presented herein as embodied by five examples.

A first example of an advanced bolt block puzzle apparatus includes using six blocks with ten same-colored bolts. Opposite faces of the assembled puzzle are the same color, six faces-three colors, two same-color intersecting bands surround the puzzle and individual blocks are also banded. A dot is displayed on all fully exposed faces of each block.

A second example of an advanced bolt block puzzle apparatus includes five individually colored blocks joined by nine one-color bolts. Three same-color intersecting bands surround the correctly assembled puzzle. Also, individual blocks are banded. A dot is visible on all exterior faces where bands intersect.

A third example of an advanced bolt block puzzle apparatus includes having six blocks joined by eleven same-colored bolts. Three of the assembled puzzle faces are one color and three are a second color. Two same-color intersecting bands may surround the puzzle and individual blocks are banded. Dots are displayed on fully exposed faces of each block.

A fourth example of a bolt block puzzle apparatus includes having seven blocks with all the same color joined by fourteen one-color bolts. Three same-color intersecting bands may surround the assembled puzzle and blocks are also individually banded. Selectively-colored dots are displayed on all fully-exposed faces. Dot colors are intended to show only exposed block faces and not as clues to the position of any particular block.

A fifth example of an advanced bolt block puzzle apparatus of the present invention may employ seven blocks with each having a different color joined by thirteen same-colored bolts. Two same-colored parallel bands may surround the assembled puzzle and individual blocks are also banded. Selectively-colored dots appear on all fully-exposed block faces. No dot appears on hidden or partially hidden block faces. In this embodiment, one of the longer bolts passes through three blocks instead of only two blocks.

It will be apparent to those skilled in the art that various modifications can be made to the bolt block puzzle apparatus of the instant invention without departing from the scope or spirit of the invention, and it is intended that the present invention cover modifications and variations of the bolt block puzzle apparatus provided they come within the scope of the appended claims and their equivalents.

I claim:

1. A puzzle for testing a person's problem solving skills, said puzzle comprising:

a plurality of bolts, each bolt having a shaft with a first end with a head and a second end, each bolt having a unique, predetermined set of dimensions different from the set of dimensions of all other bolts;

a plurality of means for fastening to the second ends of said plurality of bolts, respectively;

a plurality of blocks, each block having six rectangular sides defined by six planar surfaces wherein the planar surface of each rectangular side of each block runs perpendicular to the planar surface of each adjacent side of each block when assembled, with each block having at least two holes with predetermined diameters, with each hole located in predetermined positions on each block for assembling said plurality of blocks in a unique, predetermined pattern, with each hole traversing through each block for passing an appropriate, predetermined bolt of said plurality of bolts through an appropriate, predetermined alignment of blocks, with each block having a different predetermined height, width, and depth, and each block having a different location of each hole; and wherein said puzzle comprises said plurality of blocks assembled in a predetermined, problem-solving pattern having only one solution with each bolt of said plurality of bolts passing through the predetermined holes of at least two adjacent blocks, said bolts and said adjacent blocks having corresponding positions and corresponding diameters, with each fastening means of said plurality of fastening means attaching to the predetermined second end of one corresponding bolt of said plurality of bolts for holding said plurality of blocks together in said predetermined, problem-solving pattern such that the entire shaft is concealed within the adjacent blocks.

2. The puzzle as set forth in claim 1 wherein the second end of each of said bolts has threads and each of said fastening means includes a nut having threads for connecting to said bolts.

3. The puzzle as set forth in claim 1 wherein the second end of said bolts has threads and each of said fastening means includes a wing nut for connecting to said bolts.

4. A puzzle for testing a person's problem solving skills, said puzzle comprising:

a plurality of bolts, each bolt having a shaft with a first end with a head, and a second end with threads, each bolt having a unique, predetermined set of dimensions different from the set of dimensions of all other bolts;

a plurality of nuts, each nut having threads for screwing said nuts onto said bolts;

a plurality of blocks, each block having six rectangular sides defined by six planar surfaces wherein the planar surface of each rectangular side of each block runs perpendicular when assembled, with each block having a plurality of holes with predetermined diameters, with each hole located in predetermined positions on each block for assembling said plurality of blocks in a predetermined, problem-solving pattern, with each hole traversing through each block of said plurality of blocks, for passing said plurality of bolts and with each block having a different predetermined height, width, and depth, and each block having a different location of each hole;

wherein said puzzle comprises said plurality of blocks assembled in said predetermined, problem-solving pattern having only one solution with each bolt of said plurality of bolts passing through the holes of at least two of said blocks holding said adjacent blocks having corresponding positions and corresponding diameters, with each nut screwing onto a corresponding bolt of said plurality of bolts for holding said plurality of blocks together in said predetermined, problem-solving pattern such that the entire shaft is concealed within the adjacent blocks.

5. A puzzle for testing a person's problem solving skills, said puzzle comprising:

a plurality of blocks, each block having six rectangular sides defined by six planar surfaces wherein the planar surface of each rectangular side of each block runs perpendicular to the planar surface of each adjacent side of each block when assembled, with each block having a plurality of holes passing therethrough, with each hole having a predetermined diameter and located in predetermined positions on each block for assembling said plurality of blocks in a unique, predetermined pattern, and with each block having a different, predetermined height, width, and depth, and each block having a different location of each hole;

a plurality of first means with each of said first means having a shaft with a first end with a head and a second end, each first means having a unique, predetermined set of dimensions different from the set of dimensions of all other first means; and wherein said puzzle comprises said plurality of blocks assembled in a predetermined, problem-solving pattern having only one solution with the second end of said plurality of first means passing through the predetermined holes of at least two adjacent blocks, said plurality of first means and said adjacent blocks having corresponding positions and corresponding diameters, with said first means holding said plurality of blocks together in said predetermined, problem-solving pattern such that the entire shaft is concealed within the adjacent blocks.

6. The puzzle as set forth in claim 5 wherein said plurality of first means includes a plurality of bolts.

7. The puzzle as set forth in claim 5 further including:

a plurality of second means with each of said second means for connecting to the second ends of said plurality of first means.

8. The puzzle as set forth in claim 7 wherein said plurality of second means includes a plurality of nuts.

9. The puzzle as set forth in claim 5 wherein the plurality of first means includes a plurality of joining devices.

* * * * *